US007146950B2

(12) United States Patent
Moeck et al.

(10) Patent No.: US 7,146,950 B2
(45) Date of Patent: Dec. 12, 2006

(54) CONNECTING ELEMENT FOR INSEPARABLE RETENTION OF A LEVER-TYPE CAM FOLLOWER

(75) Inventors: Stephan Moeck, Pretzfeld (DE); Helmut Engelhardt, Herzogenaurach (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 11/172,592

(22) Filed: Jun. 30, 2005

(65) Prior Publication Data

US 2006/0011162 A1 Jan. 19, 2006

(30) Foreign Application Priority Data

Jul. 14, 2004 (DE) ..... 10 2004 033 973

(51) Int. Cl.
*F01L 1/18* (2006.01)

(52) U.S. Cl. ..... 123/90.44; 123/90.45; 123/90.42; 123/90.43; 74/559; 74/569

(58) Field of Classification Search ..... 123/90.44, 123/90.45
See application file for complete search history.

(56) References Cited

U.S. PATENT DOCUMENTS 4,539,953 A * 9/1985 Sasaki et al. ..... 123/90.41
4,598,674 A * 7/1986 Nono et al. ..... 123/90.41
4,676,203 A * 6/1987 Nouno ..... 123/90.42
6,047,675 A * 4/2000 Kunz ..... 123/90.41
6,758,180 B1 * 7/2004 Pierik ..... 123/90.39
6,889,644 B1 * 5/2005 Ferracin et al. ..... 123/90.39

FOREIGN PATENT DOCUMENTS

DE 196 40 919 A1 4/1998
JP 2002155710 A 5/2002

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

The invention proposes a connecting element (9) for retaining a lever-type cam follower (1), that serves to activate a gas exchange valve (5) of an internal combustion engine, inseparably on a support element (2) comprising a spherical end (7) on which the cam follower (1) is pivotally mounted through a concave depression (6). The connecting element (9) engages into an annular groove (8) under the spherical end (7). In a connecting element (9) of this type, a central portion (10) of the connecting element (9) bears against an underside (11) of the cam follower (1) oriented toward the support element (2) and forms, through two legs (12, 13) and a crossbar (14) connecting these legs (12, 13) to each other, a U-shaped recess (15) in longitudinal direction of the cam follower (1). This recess (15) engages around the groove (8) after the manner of a fork and orthogonally to a pivoting direction of the cam follower (1), substantially without lash. Angled retaining claws (16, 17) bent from the legs (12, 13) extend in transverse direction of the cam follower (1) and engage after the manner of pincers over side walls (18, 19) of the cam follower (1). By a clamping of the retaining claws (16, 17) through shaped sections (22, 23) directed toward inner surfaces (24, 25) of the side walls (18, 19), the U-shaped recess (15) is substantially fixed in respect of position in transverse direction of the cam follower (1) and in respect of shape.

11 Claims, 1 Drawing Sheet

CONNECTING ELEMENT FOR INSEPARABLE RETENTION OF A LEVER-TYPE CAM FOLLOWER

FIELD OF THE INVENTION

The invention concerns a connecting element for retaining a lever-type cam follower, that serves to activate a gas exchange valve of an internal combustion engine, inseparably on a support element comprising a spherical end on which the cam follower is pivotally mounted through a concave depression, said connecting element engaging into an annular groove under the spherical end.

BACKGROUND OF THE INVENTION

As known, connecting elements of the pre-cited type enable the realization of an assembled unit consisting, for instance, of a cam follower in the form of a finger lever, and a support element. Such an assembled unit minimizes the risk of a possible faulty mounting by the customer. One such error could consist in that the finger lever is mounted wrongly turned through 180° in the valve train. In this case, the contacting members, spherical head of the support element and concave depression of the finger lever, as also valve stem end and mating counter surface on the finger lever, are mistakenly exchanged. Such a faulty mounting would lead at least to a malfunction of the valve train, and, in the worst case, even to a serious damage to the engine. Further requirements made of such a connecting element are that, on the one hand, a separation of the finger lever and the support element due to transport conditions is reliably excluded and the connecting element, on the other hand, makes no negative contribution to the valve train friction during the pivoting motion of the finger lever on the support element.

DE 102 49 560 A1 proposes a connecting element that advantageously meets the aforesaid requirements. In the case of this connecting element that is made of flat material, the spherical end of the support element is clipped behind an oval recess of the connecting element, which recess is situated under the concave depression of the finger lever. In this way, the connecting element does indeed engage into the annular groove under the spherical end but it still permits a minimum-friction pivoting movement in activation direction of the gas exchange valve. A pre-condition for a perfect clipping-in of the support element behind the connecting element, however, is an elastic deformation of the latter in the region of the recess. The required elasticity can be achieved without any problem with a suitable geometry of the recess and suitable properties and thickness of the connecting element material, but a mounting gap still subsists crosswise to the activating direction of the finger lever between the connecting element and the annular groove in the support element. Consequently, a pivoting movement of the finger lever crosswise to its activating direction is also not completely impeded by the connecting element, and this pivoting movement can then have a range of up to 15°. Such a tilting of the finger lever about its longitudinal axis can likewise occur in the assembled engine, viz., upon loss of contact between the finger lever and the activating cam. Reasons for such a loss of contact can be an undesired sinking of the mostly used support elements equipped with hydraulic valve lash adjustment or a migration of the finger lever away from the activating cam due to an excessive speed of rotation of the internal combustion engine.

In this connection, special attention must be paid to finger levers with very narrow cam contacting surfaces. Such finger levers are used with multi-valve engines installed in a confined design space or also in variable valve controls in which a set of cams consisting of several cams of different lifts is mounted for axial displacement on a camshaft and one of these cams suited to the operating state of the engine has to be brought into engagement with the finger lever. In such an arrangement, there is a great danger of the finger lever tilting further away from or completely off the support element because, for a renewed contact with its cam, the finger lever can no longer align itself adequately with the cam due to the narrow cam contacting surface.

OBJECTS OF THE INVENTION

It is an object of the invention to provide a connecting element of the pre-cited type in which the aforesaid drawbacks are eliminated, so that, particularly in the case of cam followers with very narrow cam contacting surfaces, a stable alignment with the activating cam can be guaranteed in all operating states of the internal combustion engine.

This and other objects and advantages of the invention will become obvious from the following detailed description.

SUMMARY OF THE INVENTION

The invention achieves the above objects by the fact that a central portion of the connecting element bears against an underside of the cam follower oriented toward the support element and forms, through two legs and a crossbar connecting these legs to each other, a U-shaped recess in longitudinal direction of the cam follower, said recess engages around the groove after the manner of a fork and orthogonally to a pivoting direction of the cam follower, substantially without lash, angled retaining claws bent from the legs extend in transverse direction of the cam follower and engage after the manner of pincers over side walls of the cam follower, so that by a clamping of the retaining claws through shaped sections directed toward inner surfaces of the side walls, the U-shaped recess is substantially fixed in respect of position in transverse direction of the cam follower and in respect of shape.

In this way, the aforesaid drawbacks are eliminated with simple measures. The design of the connecting element guarantees that the cam follower is inseparably connected to the support element and, at the same time, the tilting ability of the cam follower about its length direction is minimized. The latter is mainly achieved by the fact that the connecting element surrounds the annular groove with its U-shape, so that it can be pulled onto the cam follower like a shoe when the spherical end of the support element is already in place in the concave depression. Thus, an elastic deformation of the connecting element such as occurs when clipping in the support element, and the concomitant mounting gap between the connecting element and the annular groove are no longer required. The modest elasticity requirement further permits the use of a connecting element with a large material thickness that, through the absence of lash relative to the annular groove as also through a high component rigidity, effectively prevents a tilting of the cam follower.

Even then, the material thickness of the legs can be limited without any problem to be smaller than the axial width of groove, so that, during pivoting movements of the cam follower in activating direction of the gas exchange valve, the connecting element can move geometrically freely in the groove. Thus, the connecting element participates without deformation in the pivoting motion of the cam follower and, moreover, it does not produce any additional friction loss during activation of the gas exchange valve.

For mounting on the cam follower, the connecting element is preferably made of a resilient material like spring steel. Alternatively, however, it is also possible to use light metals or plastics that are reinforced with fibers or particles. Specially preferred is the use of a flat material.

The cam follower is advantageously a finger lever. The cam contacting surface of the finger lever can be a sliding surface but particularly preferred is a rotating roller. Finally, the finger lever should have a generally U-shaped cross-section. However, a cross-section only similar to a U, an H-shaped cross-section or the like may also be used in place of the U-shaped cross-section. In combination with this feature, the invention proposes to make the finger lever of a sheet metal. However, it is naturally also conceivable to use other materials that are suitable for the purpose, such as, for example, plastics or finger levers made by shaping methods. The scope of the invention also explicitly includes the U-shape even without combination with a sheet metal.

The invention will now be disclosed more closely with reference to the appended drawing which illustrates one example of embodiment of the invention.

DETAILED DESCRIPTION OF THE DRAWING

Figure 1:
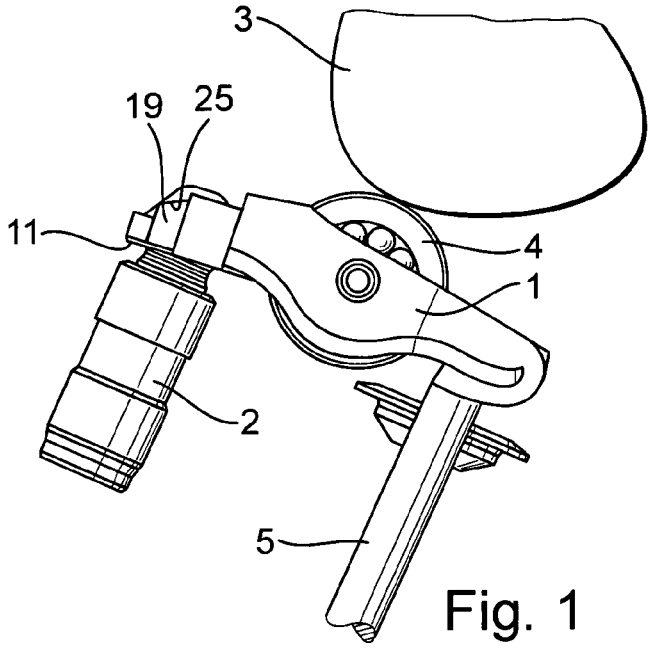
FIG. 1 is a side view of the connecting element of the invention in a ready-for-work assembled state of the valve train.
Figure 2:
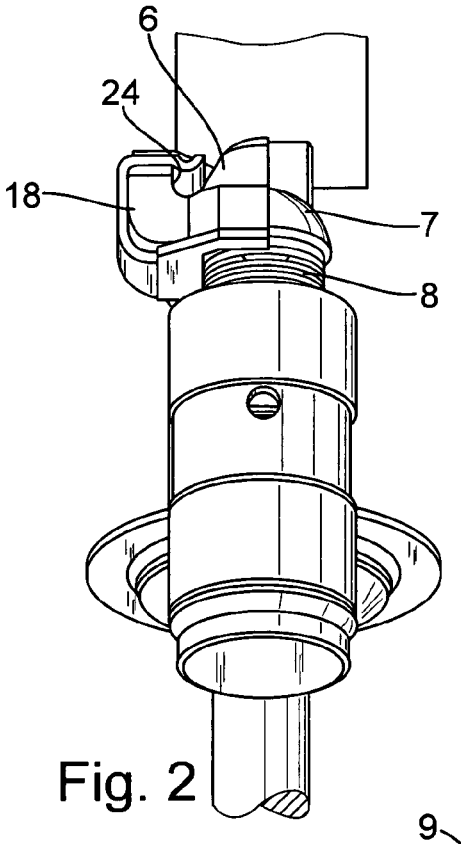
FIG. 2 is a rear view of the valve train, partly in section.
Figure 3:
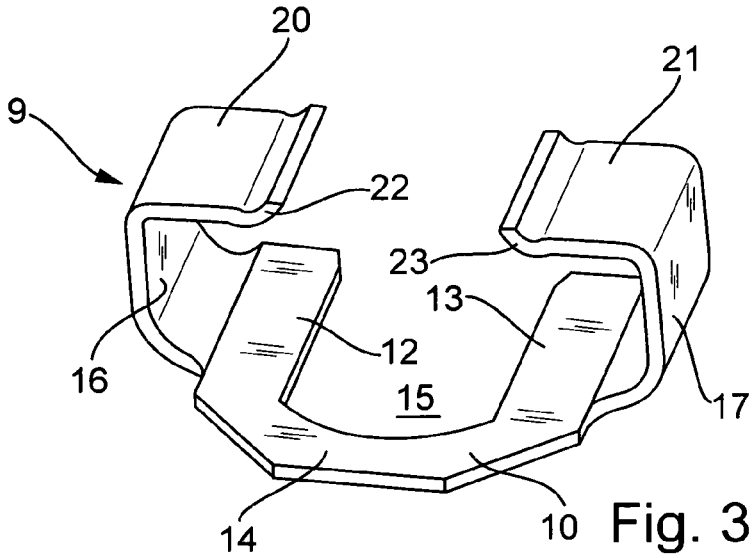
FIG. 3 is a perspective representation of the connecting element of the invention.

FIGS. 1 to 3 show a cam follower 1 and a support element 2 for pivotally mounting the cam follower 1. The support element 2 in the present case is equipped with a hydraulic lash adjuster, not shown. The cam follower 1 is driven in activating direction of a gas exchange valve 5 in a manner known per se through a cam 3 with the help of a rotatably mounted roller 4 that is connected to the cam follower 1. It is understood that it is also possible to use a sliding surface rigidly connected to the cam follower 1 as a cam contacting surface in place of the roller 4. In the embodiment illustrated, the cam follower 1 is a finger lever that has a U-shaped cross-section and is preferably made out of sheet metal by a shaping method.

The cam follower 1 comprises a concave depression 6 through which it is mounted on a spherical end 7 of the support element 2. As best seen in FIG. 2, under the spherical end 7 is situated an annular groove 8 into which a connecting element 9, made in the present embodiment of a flat material, engages. The connecting element 9 bears through a central portion 10 against an underside 11 of the cam follower 1 oriented toward the support element 2. The central portion 10 comprises two legs 12, 13 that are connected to each other by a crossbar 14 and form a U-shaped recess 15 in longitudinal direction of the cam follower 1. It can also be seen from FIG. 2 that the legs 12, 13 engage around the groove 8 without lash, perpendicularly to the activating direction of the cam follower 1.

Angled retaining claws 16, 17 starting from the legs 12, 13 extend in a transverse direction of the cam follower 1 after the manner of pincers over the side walls 18, 19 of the cam follower 1. End portions 20, 21 of the retaining claws 16, 17 comprise shaped sections 22, 23 that are directed toward inner sides 24, 25 of the side walls 18, 19. The thus configured retaining claws 16, 17 produce a clamping of the connecting element 9 on the side walls 18, 19 of the cam follower 1. On the one hand, this clamping produces a frictional engagement with the connecting element 9, which frictional engagement is effective in longitudinal direction of the cam follower 1, so that, even in the operating state of the internal combustion engine, a slipping of the connecting element 9 on the cam follower 1 is efficiently prevented. On the other hand, due to the clamping, the position of the U-shaped recess 15 relative to the concave depression 6 is fixed.

It can also be clearly seen that the connecting element 9 can be pushed easily onto the cam follower 1 for assembly when the spherical end 7 of the support element 2 is already in place in the concave depression 6. The connecting element 9 can thus be configured with a large material thickness and a low elasticity and, through the absence of lash relative to the annular groove as also through the high component rigidity, can still efficiently prevent a tilting of the cam follower 1

Even then, the legs 12, 13 still have a material thickness that is smaller than the axial width of the groove 8. In this way, during pivoting movements of the cam follower 1 in activating direction of the gas exchange valve 5, the connecting element 9 can move freely in the groove 8, so that the connecting element 9 is neither deformed during operation of the internal combustion engine nor does it contribute to friction loss therein.

Suitable materials for the connecting element 9 of the invention are naturally any materials that satisfy the technical as well as the financial requirements. Thus, besides resilient steels and light weight materials, it is naturally also possible to use plastics reinforced with particles or fibers. Due to their low density, these have a negligible share in the moving mass of the valve train.

The invention claimed is:

1. A connecting element for retaining a lever-type cam follower, that serves to activate a gas exchange valve of an internal combustion engine, inseparably on a support element comprising a spherical end on which the cam follower is pivotally mounted through a concave depression, said connecting element engaging into an annular groove under the spherical end, wherein a central portion of the connecting element bears against an underside of the cam follower oriented toward the support element and forms, through two legs and a crossbar connecting these legs to each other, a U-shaped recess in longitudinal direction of the cam follower, said recess engages around the groove after the manner of a fork and orthogonally to a pivoting direction of the cam follower, substantially without lash, angled retaining claws bent from the legs extend in transverse direction of the cam follower and engage after the manner of pincers over side walls of the cam follower, so that by a clamping of the retaining claws through shaped sections directed toward inner surfaces of the side walls, the U-shaped recess is substantially fixed in respect of position in transverse direction of the cam follower and in respect of shape.

2. A connecting element of claim 1, wherein the connecting element can be pushed onto the cam follower in parallel orientation to a longitudinal direction of the cam follower, the spherical end of the support element being already in place in the concave cavity when the connecting element is pushed onto the cam follower.

3. A connecting element of claim 1, wherein the legs have a material thickness that is smaller than an axial width of the groove, so that, during pivoting movements of the cam follower in activating direction of the gas exchange valve, the connecting element can move geometrically freely in the groove.

4. A connecting element of claim 1, wherein the connecting element is made of a resilient material.

5. A connecting element of claim 4, wherein the resilient material is a spring steel.

6. A connecting element of claim 4, wherein the resilient material is a light-weight metal.

7. A connecting element of claim 4, wherein the resilient material is a fiber-reinforced plastic.

8. A connecting element of claim 4, wherein the resilient material is a particle-reinforced plastic.

9. A connecting element of claim 1, wherein the connecting element is made of flat material.

10. A connecting element of claim 1, wherein the cam follower is a finger lever.

11. A connecting element of claim 10, wherein the finger lever has a generally U-shaped cross-section and is made without chip removal from a sheet metal.

* * * * *